United States Patent [19]

Palmer

[11] 4,025,982

[45] May 31, 1977

[54] CLEANING DEVICE

[76] Inventor: Ray L. Palmer, 3951 Conning St., Riverside, Calif. 92509

[22] Filed: June 16, 1976

[21] Appl. No.: 696,810

[52] U.S. Cl. ..... 15/106; 15/104.2; 15/160

[51] Int. Cl.[2] ..... A46B 15/00

[58] Field of Search ..... 15/160, 162, 164, 206, 15/104.2, 104.3 R, 104.3 SN, 106, 104.16, 210 R

[56] References Cited

UNITED STATES PATENTS

| | | | |
|---|---|---|---|
| 750,357 | 1/1904 | Gibbons | 15/104.3 R X |
| 1,154,369 | 9/1915 | Browning | 15/104.3 SN X |
| 2,825,084 | 3/1958 | Sanborn | 15/210 R |

FOREIGN PATENTS OR APPLICATIONS

| | | | |
|---|---|---|---|
| 129,445 | 7/1919 | United Kingdom | 15/106 |
| 234,668 | 6/1925 | United Kingdom | 15/162 |

*Primary Examiner*—Edward L. Roberts
*Attorney, Agent, or Firm*—Fulwider, Patton, Rieber, Lee & Utecht

[57] ABSTRACT

A flexible cleaning device capable of reaching into and past drains and traps of common plumbing fixtures and being manipulated in a back and forth scrubbing action while so placed, comprising an integrally formed, elongated stem made of a flexible plastic material and having a large spherical brush on one end and a like smaller brush on the other. A plurality of spaced ball-like enlargements are formed substantially along the entire length of the stem to stiffen and guide it along these remote passageways.

12 Claims, 3 Drawing Figures

CLEANING DEVICE

BACKGROUND OF THE INVENTION

This invention relates generally to cleaning devices and, more specifically, to a cleaning device specially adapted for reaching into and past remote regions of plumbing fixtures and associated plumbing.

Some of the most fertile locations known for the collection of harmful microorganisms, such as bacteria and the like, are in the drains and traps associated with common plumbing fixtures. Fof instance, the ordinary trap employed in sink and toilet drains holds a pool of water which can remain essentially stagnant for hours at a time. Under normal circumstances, this allows slime to form and colonies of microorganisms to collect and thrive only inches from human contact. This situation presents a potential health hazard which can be particularly grave for certain susceptible individuals Although it is highly desirable that these remote passageways in plumbing fixtures be regularly cleansed to impede the growth of slime and microorganisms, it has not been a common practice to do so. A major reason for this is that these cavities and passageways are relatively inaccessible to ordinary cleaning devices, such as toilet brushes and the like. To do an effective cleaning job, it is usually necessary that a brush end or other cleaning head be manipulated past sharp turns and corners in the fixtures. At least until the present invention, a cleaning device has not been available which could be so maneuvered and still be capable of performing an effective scrubbing action in these tight areas.

Hence, it can be seen that there is a great need for a cleaning device capable of being manipulated into remote locations of plumbing fixtures and performing scrubbing actions when so placed. The present invention clearly fulfills this need.

SUMMMARY OF THE INVENTION

Briefly, and in general terms, the present invention resides in a cleaning device comprising a cleaning head on one or both ends of a flexible elongated stem capable of bending around tight turns in plumbing fixtures while providing sufficient rigidity to accomplish back and forth scrubbing action of the cleaning head.

The stem, which is formed of a flexible material such as plastic, has alternating narrowed and enlarged laterally extending portions formed over a substantial portion of its length. The narrowed portions allow the stem to flex and bend about sharp corners in the plumbing fixtures, while the enlarged portions provide rigidity and help guide the stem along the remote passageways during back and forth scrubbing movement. This cleaning device can be inexpensively manufactured and is quite effective in cleansing drains and traps where slime and harmful microorganisms would otherwise be free to grow.

More specifically, and as illustrated in the presently preferred embodiment shown herein, the cleaning device comprises a spherical brush formed on each end of an elongated and generally tapered stem. The stem is formed of plastic and has ball-like spaced enlargments integrally formed substantially along it entire length. The rounded features of these enlargements are preferable to allow the stem to be easily manipulated in a back and forth scrubbing movement around tight corners in the plumbing fixtures.

The stem is formed as a unitary structure and care is taken to avoid seams or crevices in it where microorganisms can collect. The narrowed portions of the stem form an advantageous hand grip to facilitate handling of the device.

Each bruch is formed by radially projecting bristles and is preferably rounded to insure its cleaning effectiveness regardless of its orientation within a particular passageway. The brushes are ideally of different sizes to accomodate the smallest and largest cavities likely to be encountered in ordinary use.

An important aspect of the invention is the snakelike quality of the stem which allows the cleaning device to also perform the function of a plumber's snake for unblocking clogged drains and traps.

Other aspects and advantages of the invention will become apparent from the following detailed description, taken in conjuction with the accompanying drawing.

DETAILED DESCRIPTION

Figure 1:
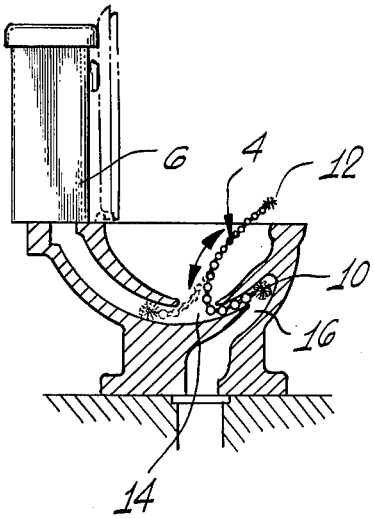
FIG. 1 is a reduced elevational view showing the cleaning device in use in the drain trap area of a toilet, shown partly in section, an alternate use of the cleaning device being shown in phantom.
Figure 2:
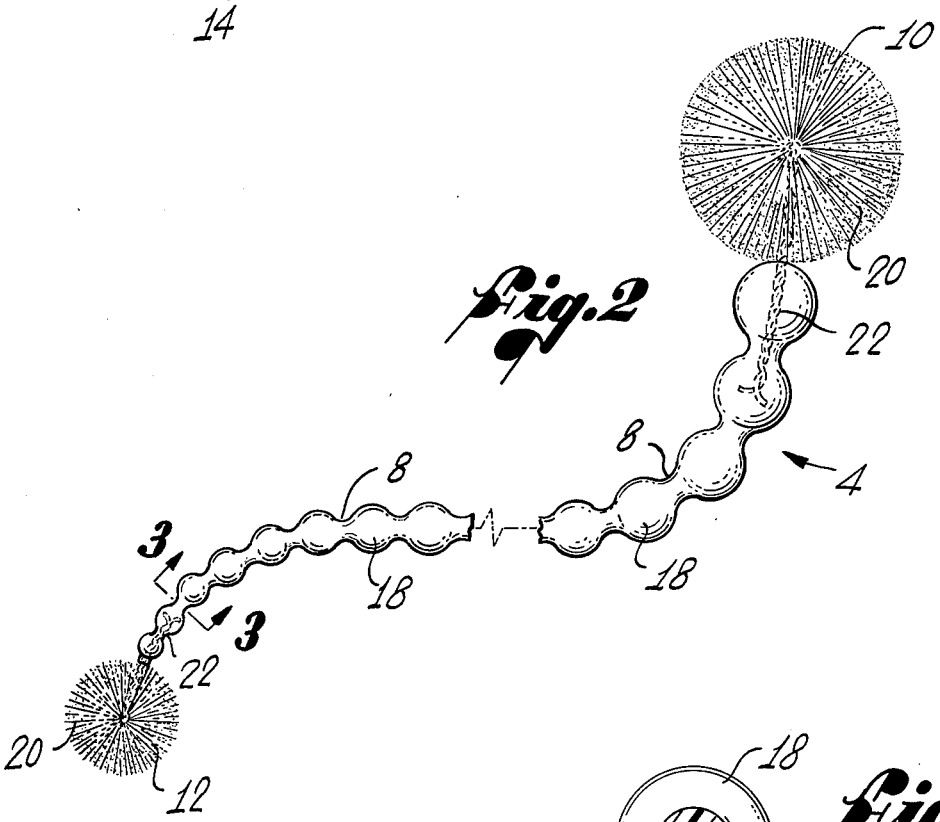
FIG. 2 is a plan view of the cleaning device shown in FIG. 1.
Figure 3:
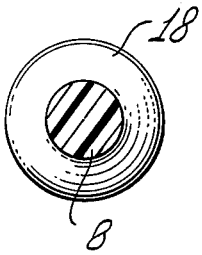
FIG. 3 is a cross-sectional view of the cleaning device stem, taken along the lines 3—3 in FIG. 2.

Referring now to the drawing, and particularly to FIGS. 1 and 2 thereof, there is shown a cleaning device, indicated generally by the reference number 4, in accordance with a presently preferred embodiment of the invention for scrubbing remote passageways and locations of plumbing fixtures such as a toilet 6 (shown in FIG. 1 only).

The cleaning device 4 comprises a relatively small diameter, flexible stem 8 having cleaning heads 10, 12 in the shape of a spherical brush provided at each end thereof. The stem 8 is integrally formed of a flexible material, such as plastic, which is sufficiently flexible to enable the stem to bend about sharp turns encountered in drains 14 and traps 16 illustrated in the toilet 6 and yet is resilient and durable to give the cleaning device 4 a long life. One plastic material known to possess these qualities is polyethylene.

In order to stiffen and guide the stem 8 along the remote passageways in the toilet 6 and other plumbing fixtures, a plurality of spaced ball-like enlargements 18 are formed along the stem over substantially its entire length. These enlargements 18 enable the cleaning heads 10, 12 to be manipulated in a controlled back and forth scrubbing action while the stem 8 is contorted about sharp turns in the toilet 6, such as that shown in FIG. 1.

The enlargements 18 are preferably rounded so that they will more easily slide past the turns in the drains 14 and traps 16. This configuration has the further advantage of providing a convenient and comfortable handgrip for the user of the cleaning device 4.

The cleaning heads 10, 12 provided at each end of the stem 4 are formed by radially projecting, stiff bristles 20, which can be nylon or any other well-known bristle material. The bristles are held together by any of a number of well-known means, such as by the twisted wire 22, which is preferably embedded in the ends of the stem 8 for securely fastening the cleaning heads 10, 12 thereto. Alternatively, suitable means may be provided on the ends of the stem for removably attaching the brushes thereto.

The bristles 20 preferably collectively create a rounded shape for the cleaning heads 10, 12 so that the user need not be concerned about the relative angular position of the cleaning heads when out of view in remote passageways. In the preferred embodiment, the cleaning heads 10, 12 are spherical to render them as non-directional as possible.

To increase the utility of the cleaning device 4. the cleaning head 10 is substantially larger than the cleaning head 12 to accomodate as wide a range of drain and trap sizes as practical. The stem 8 gradually tapers in lateral cross-sectional area from cleaning head 10 to cleaning head 12, since it is desirable that the stem be no larger than necessary to support a cleaning head. The advantage in this is that the stem 8 is made as flexible as possible relative to the size of the cleaning head it supports.

It will be appreciated that the cleaning device of the present invention has properties much like the ordinary plumber's snake and therefore it can also be used in this role. Moreover, since the stem 8 is preferably formed of plastic, rather than the abrasive metal of most plumber's snakes, it is useable in connection with the enameled surfaces of common plumbing fixtures without damaging them. Furthermore, if the brushes are removably attached to the stem 8, other tools may be substituted therefor, if desired.

The present invention satisfies a long existing need for a cleaning device capable of reaching into and past remote regions of plumbing fixtures.

It will be apparent from the foregoing that, while a particular form of the invention has been illustrated and described, various modifications can be made without departing from the spirit and scope of the invention.

I claim:

1. A cleaning device for cleaning plumbing fixtures and particularly adapted for reaching around bends and traps in remote passageways therein, comprising:

an elongated stem formed of a flexible plastic material, said stem having a plurality of spaced ball-like enlargements integrally formed substantially along its entire length between the opposite ends thereof, and adapted to have a brush attached on at least one end of said stem.

2. A cleaning device as defined in claim 1, wherein:

a first brush is attached on one end of said stem and a substantially smaller second brush is attached at the opposite end of said stem.

3. A cleaning device as as defined in claim 1, wherein the lateral cross-sectional area of said stem progressively tapers from one end thereof to the other end thereof.

4. A cleaning device as defined in claim 2, wherein at least one of said brushes in generally spherical in shape.

5. A cleaing device for cleaning plumbing fixtures and particularly adapted for reaching around bends and traps in remote passageways therein, comprising:

a flexible elongated stem having a plurality of alternating narrowed and enlarged laterally extending portions integrally formed therealong between its opposite ends; and cleaning means for cleaning the plumbing fixtures provided on at least one end of said stem.

6. A cleaning device as defined in claim 5, wherein said enlarged laterally extending portions are rounded.

7. A cleaning device as defined in claim 6, wherein said stem is formed of a flexible plastic material.

8. A cleaning device as defined in claim 7, wherein the cleaning means is embedded in the end of the plastic stem.

9. A cleaning device as defined in claim 8, wherein said cleaning means comprises a brush having radially extending, relatively stiff bristles.

10. a cleaning device as defined in claim 9, wherein said brush is rounded.

11. A cleaning device as defined in claim 5, wherein the lateral cross-sectional area of said stem progressively tapers from one end thereof to the other end thereof.

12. A cleaning device as defined in claim 11, wherein said stem is formed of resilient plastic.

* * * * *